United States Patent [19]

Kishino et al.

[11] Patent Number: 4,617,491

[45] Date of Patent: Oct. 14, 1986

[54] FLUORESCENT DISPLAY DEVICE WITH INTERLEAVED ANODE AND CONTROL ELECTRODE SEGMENTS

[75] Inventors: Takao Kishino; Ikuo Marushima; Nobumitsu Kanetsuna, all of Mobara, Japan

[73] Assignee: Futaba Denshi Kogyo K.K., Mobara, Japan

[21] Appl. No.: 513,389

[22] Filed: Jul. 13, 1983

[30] Foreign Application Priority Data

| | | | |
|---|---|---|---|
| Jul. 16, 1982 | [JP] | Japan | 57-124873 |
| Jul. 27, 1982 | [JP] | Japan | 57-114270[U] |
| Aug. 17, 1982 | [JP] | Japan | 57-142258 |

[51] Int. Cl.[4] ..... H01J 31/15

[52] U.S. Cl. ..... 313/497

[58] Field of Search ..... 313/496, 497

[56] References Cited

U.S. PATENT DOCUMENTS

| | | | |
|---|---|---|---|
| 4,004,186 | 1/1977 | Bylander | 313/497 X |
| 4,395,654 | 7/1983 | Hattori et al. | 313/496 |

FOREIGN PATENT DOCUMENTS

| | | | |
|---|---|---|---|
| 0091546 | 7/1980 | Japan | 313/497 |
| 0050040 | 5/1981 | Japan | 313/497 |

*Primary Examiner*—Palmer C. DeMeo

*Attorney, Agent, or Firm*—Oblon, Fisher, Spivak, McClelland & Maier

[57] ABSTRACT

A fluorescent display device is disclosed which is capable of carrying out an operation by segment scanning, display of high luminance and low power consumption. The display device is constructed in a manner such that segments of a display section each comprise anodes and control electrodes alternately arranged in a pectinate pattern on one surface of a substrate with an insulating space being interposed therebetween, and the anodes each have a phosphor layer deposited on the surface thereof opposite to a cathode.

4 Claims, 11 Drawing Figures

FLUORESCENT DISPLAY DEVICE WITH INTERLEAVED ANODE AND CONTROL ELECTRODE SEGMENTS

BACKGROUND OF THE INVENTION

1. Field of the Invention

This invention relates to a fluorescent display device comprising a cathode, and anodes and control electrodes arranged opposite to the cathode, and more particularly to a fluorescent display device including anodes each having a phosphor layer deposited thereon and control electrodes which are alternately arranged in a pectinate pattern on one surface of a substrate.

2. Description of the Prior Art

A fluorescent display device which has been conventionally used is typically constructed in such a manner to encapsulate anodes each formed into a desired character or figure shape and having a fluorescent material depositied thereon, a filamentary cathode arranged opposite to the anodes and grid-like control electrodes interposed between the anodes and the cathode in a transparent evacuated envelope, so that electrons emitted from the cathode impinge on the desired anodes to accomplish luminous display of desired characters or figures.

However, the conventional fluorescent display device has a disadvantage of substantially decreasing in luminance to render the observation of display from the cathode side difficult, because the control electrodes are interposed between the anodes and the cathode to obstruct the visual field when viewing display through the cathode.

Also, the conventional fluorescent display device includes display sections of plural digits for displaying characters or the like, each of which generally consists of a plurality of segments, and the control electrodes are arranged in a lump for every display section. Thus, even when causing only one of the segments of each display section to emit light, it is necessarily required to apply positive potential to all the control electrodes for the display section of one digit. This causes electrons to flow into all the control electrodes for the display section of one digit.

In this instance, the use of a segment scanning method for a dynamic driving operation of a fluorescent display tube often causes positive potential to be applied to the control electrodes for the display sections of all digits, for example, when the respective display sections carry out display of the same figure. This causes electric current flowing into the control electrodes to substantially increase, resulting in the cathode being eroded. Thus, in the conventional display device, the segment scanning method is hindered from being put into practice.

In view of the foregoing, the conventional fluorescent display tube is obliged to adopt a digit scanning method. However, the digit scanning method, depending upon its scanning manner, has a disadvantage that when the number of digits increases, for example, as in a bar display, the overall luminescence of display decreases because it is impossible to obtain sufficient duty ratio of display. In addition, the digit scanning method has another disadvantage of decreasing the utilization factor of electric power to cause the increase of power consumption because electric current flowing into the control electrodes is reactive current which never contributes to light emission.

SUMMARY OF THE INVENTION

The present invention has been made in view of the foregoing disadvantage while taking notice of the fact that light emission of anodes can be readily observed without any obstruction of the visual field due to control electrodes by causing the control electrodes to carry out the control of diffusion and acceleration of electrons on the surface of a substrate having anodes arranged thereon and the fact that the decrease of power consumption and the segment scanning can be effectively accomplished by alternately arranging the control electrodes and anodes in a pectinate pattern to obstructively act electric field of non-luminous anodes on the portions of the control electrodes adjacent to the non-luminous anodes to prevent electrons from flowing into the portions of the control electrodes.

Accordingly, it is an object of the present invention to provide a fluorescent display device which is capable of eliminating the disadvantages of the prior art such as the limitation on utilization of scanning systems and the lack of luminance due to structure peculiar to the conventional fluorescent display tube and accomplishing the utilization of a segment scanning method and display of high luminance even when the number of digits is large.

It is another object of the present invention to provide a fluorescent display device which is capable of eliminating the other disadvantages of the prior art such as obstruction of the visual field and the large power consumption due to structure peculiar to the conventional fluorescent display tube and carrying out display of excellent luminance and significantly low power consumption.

In accordance with the present invention, there is provided a fluorescent display device comprising a substrate; at least one display section formed on said subtrate, said display section consisting of a plurality of segments; and cathode; said segments each comprising anodes and control electrodes alternately arranged on one surface of said substrate with an insulating space being interposed therebetween; said anodes each having a phospher layer deposited on the surface thereof opposite to said cathode.

BRIEF DESCRIPTION OF THE DRAWINGS

Other objects and many of the attendant advantages of the present invention will be readily appreciated as the same becomes better understood by reference to the following detailed description when considered in connection with the accompanying drawings, in which like reference numerals designate corresponding parts throughout the figures thereof and wherein.

DETAILED DESCRIPTION OF THE PREFERRED EMBODIMENTS

Now, a fluorescent display device according to the present invention will be herinafter described with reference to the accompanying drawings.

Figure 1:
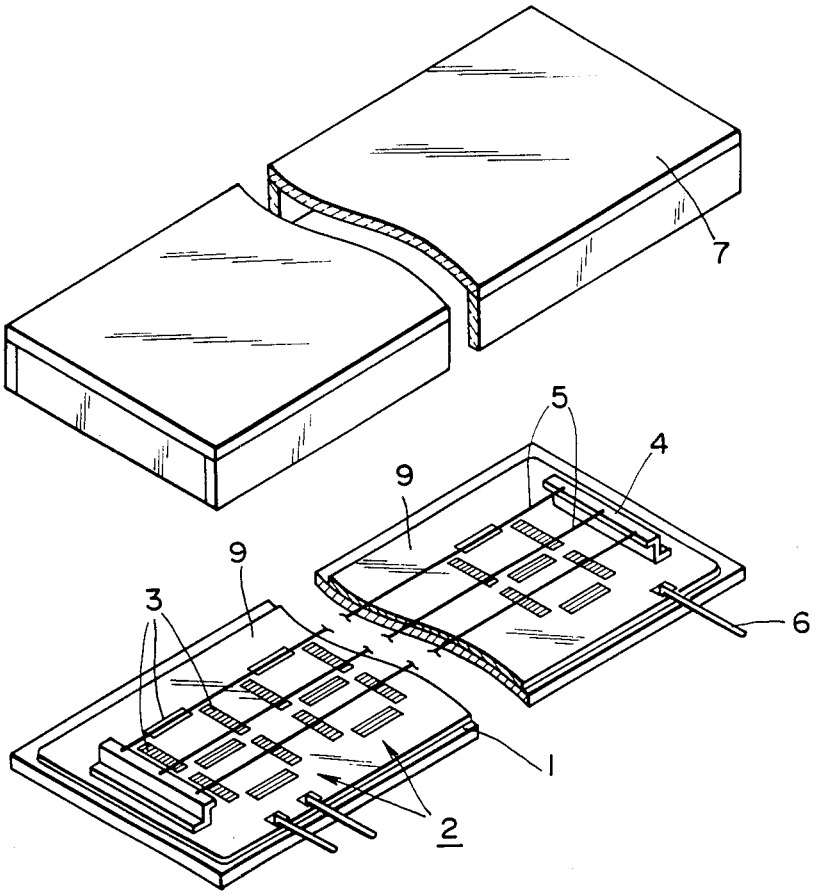
FIG. 1 is an exploded partially cutaway perspective view showing one embodiment of a fluorescent display device according to the present invention.

FIG. 1 illustrates one embodiment of a fluorescent display device according to the present invention. The fluorescent display device of the illustrated embodiment includes a substrate 1 made of an insulating material such as glass or the like, which has display sections 2 of plural digits formed thereon. The display sections 2 each consist of a plurality of display sections 3. The fluorescent display device also includes at least one filamentary cathode 5 stretched above the display sections 2, the cathode being supported by supporting members 4. Further, the embodiment includes external terminals 6 and a glass cover 7.

Figure 2:
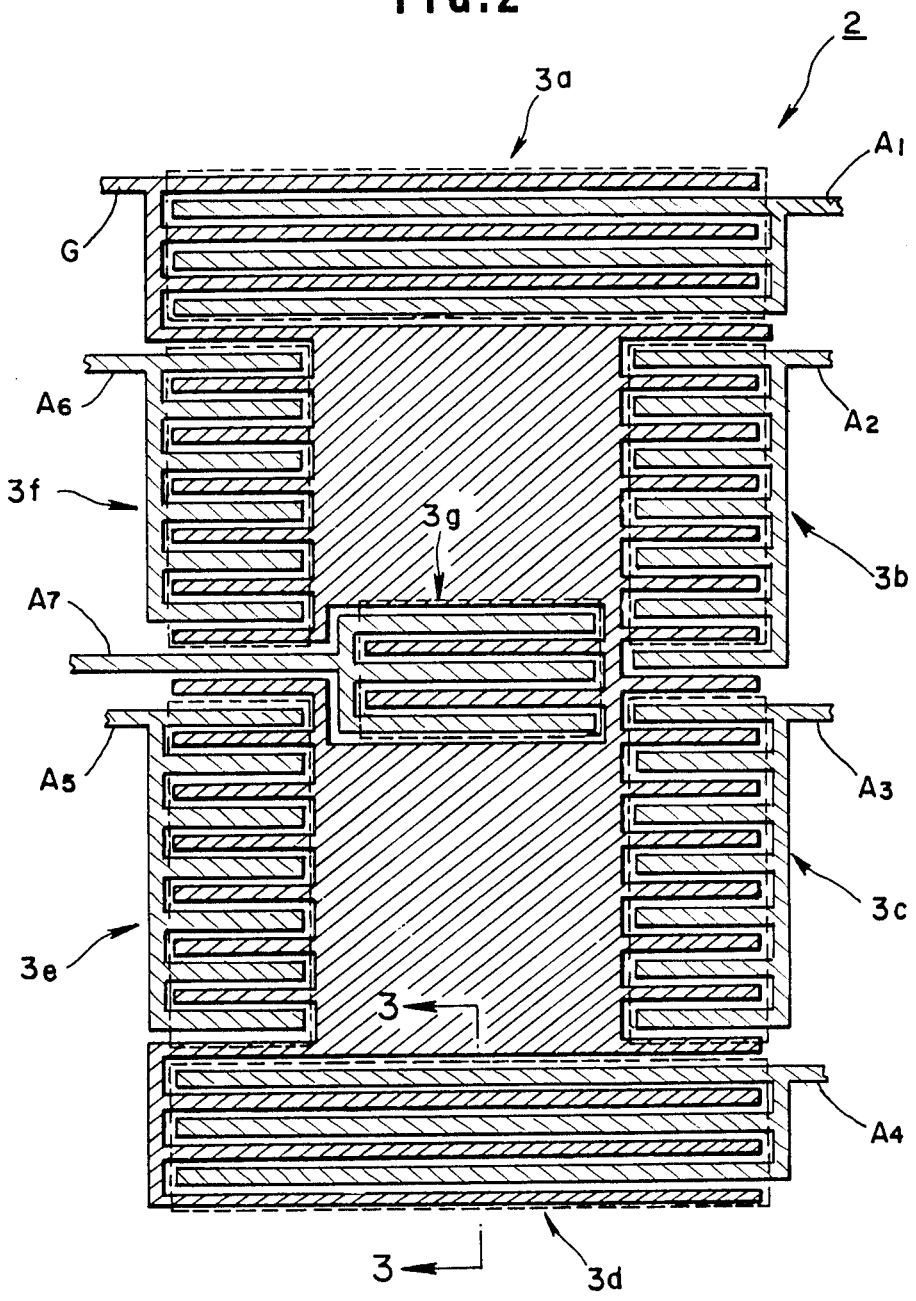
FIG. 2 is an enlarged view showing the essential part of the fluorescent display device shown in FIG. 1.
Figure 3:
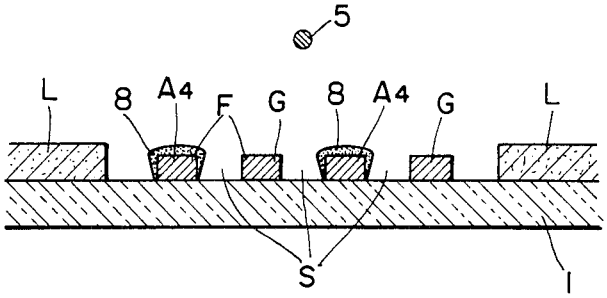
FIG. 3 is a vertical sectional view taken along line 3—3 of FIG. 2.

In the emobdiment, the display sections 2, as detailedly shown in FIG. 2, each include seven segments 3*a* to 3*g*. The segment 3 comprises anodes A and control electrodes or grids G which are alternately arranged in a pectinate shape on the substrate 1, each pair of anodes and control electrode forming a fragment F (FIG. 3). The anode A and control electrode G of each pair alternately arranged on the substrate 1, as clearly shown in FIG. 3, have an insulating space S defined therebetween, and the anodes A each have phosphor layer 8 deposited on the surface thereof opposite to the cathode 5. The width of the electrodes A and G and the intervals therebetwen are preferably small so as to exhibit a good shielding effect and form display of good continuity. The electrodes suitable for such purpose may be formed, for example, according to such a film deposition procedure as conventionally used in the manufacture of a semiconductor.

Around each of the segments 3, a light-impermeable insulating layer L is provided to form a display contour having a window as shown in dotted lines in FIG. 2. The insulating layer L is desirably formed of a mixture of an insulating material such as a glass powder with trace amounts of metal particle rather than only the insulating material so that it may be somewhat provided with conductivity. This allows electrons flowing from the cathode 5 into the control electrodes G to be removed therefrom to effectively prevent electrification of the control electrodes, to thereby eliminate any adverse influence upon a passage of electrons into the control electrodes.

Figure 4:
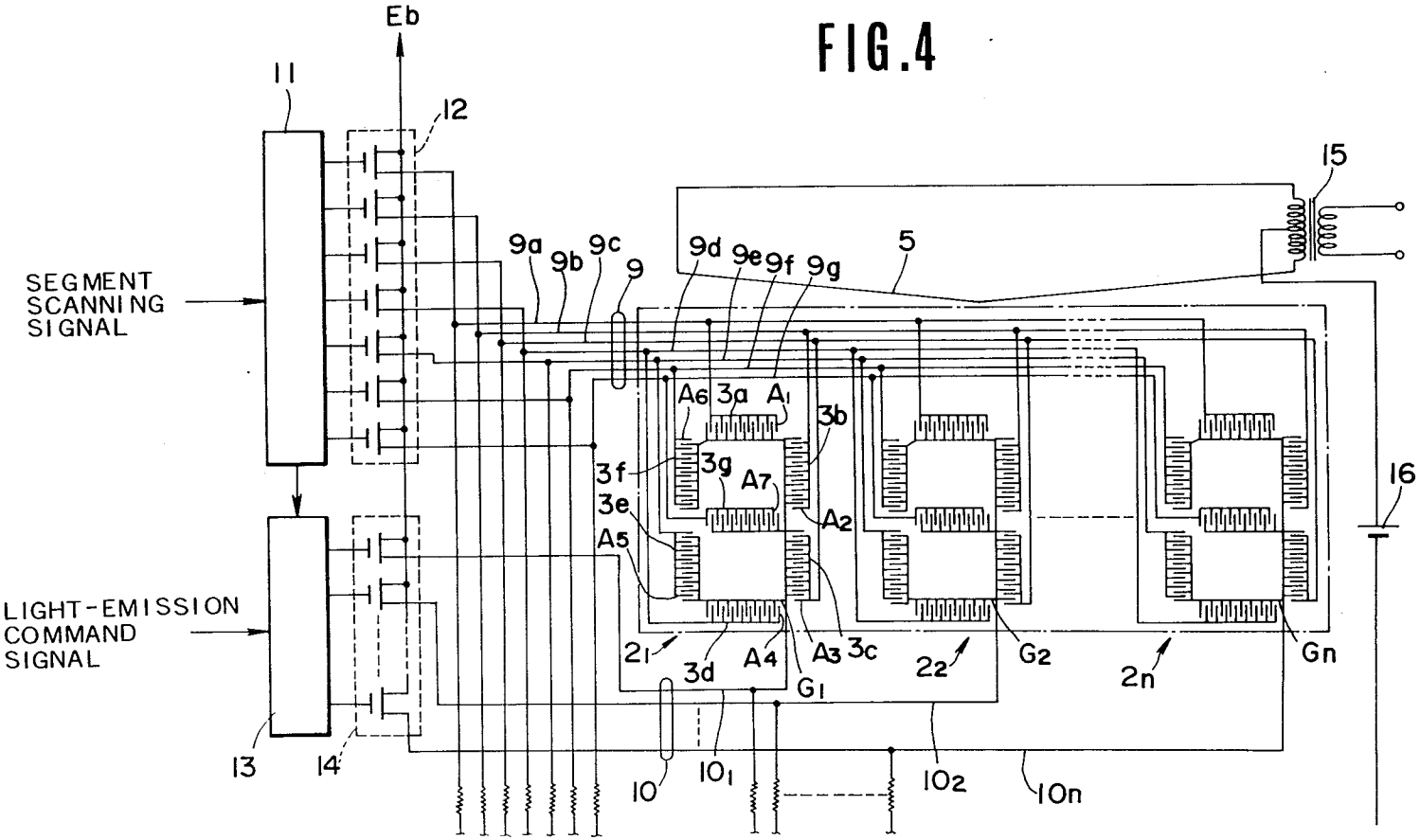
FIG. 4 is a diagram showing an electrical connection in the fluorescent display device shown in FIG. 1.

The anodes A of each display section 2, as shown in FIG. 4, are led out together every segment. More particularly, the anodes $A_1$ of the segment 3*a* are connected with a first segment signal conductor 9*a* and the anodes $A_2$ to $A_7$ of the segments 3*b* to 3*g* are respectively connected to second to seventh segment signal conductors 9*b* to 9*g*. Further, the anodes of the corresponding segments in the respective display sections $2_1$ to $2_n$ are connected to the same segment signal conductors 9.

The control electrodes G of the display sections 2 are led out together every display section in a manner such that the control electrodes $G_1$ to $G_n$ of the display sections $2_1$ to $2_n$ are connected to grid signal conductors $10_1$ to $10_n$, respectively.

To the segments of the display sections 2, a segment scanning signal is supplied in turn from a segment scanning means 11, which is connected through a driver 12 to the segment signal conductors 9. To the control electrodes G of the segments 3 which have a segment scanning signal supplied thereto and are to emit light, a light-emission command signal is selectively supplied from a light-emission commands signal means 13 which is connected through a driver 14 to the grid signal conductors 10. Reference numerals 15 and 16 respectively designate a cathode source and a cut-off bias source.

Figure 5:
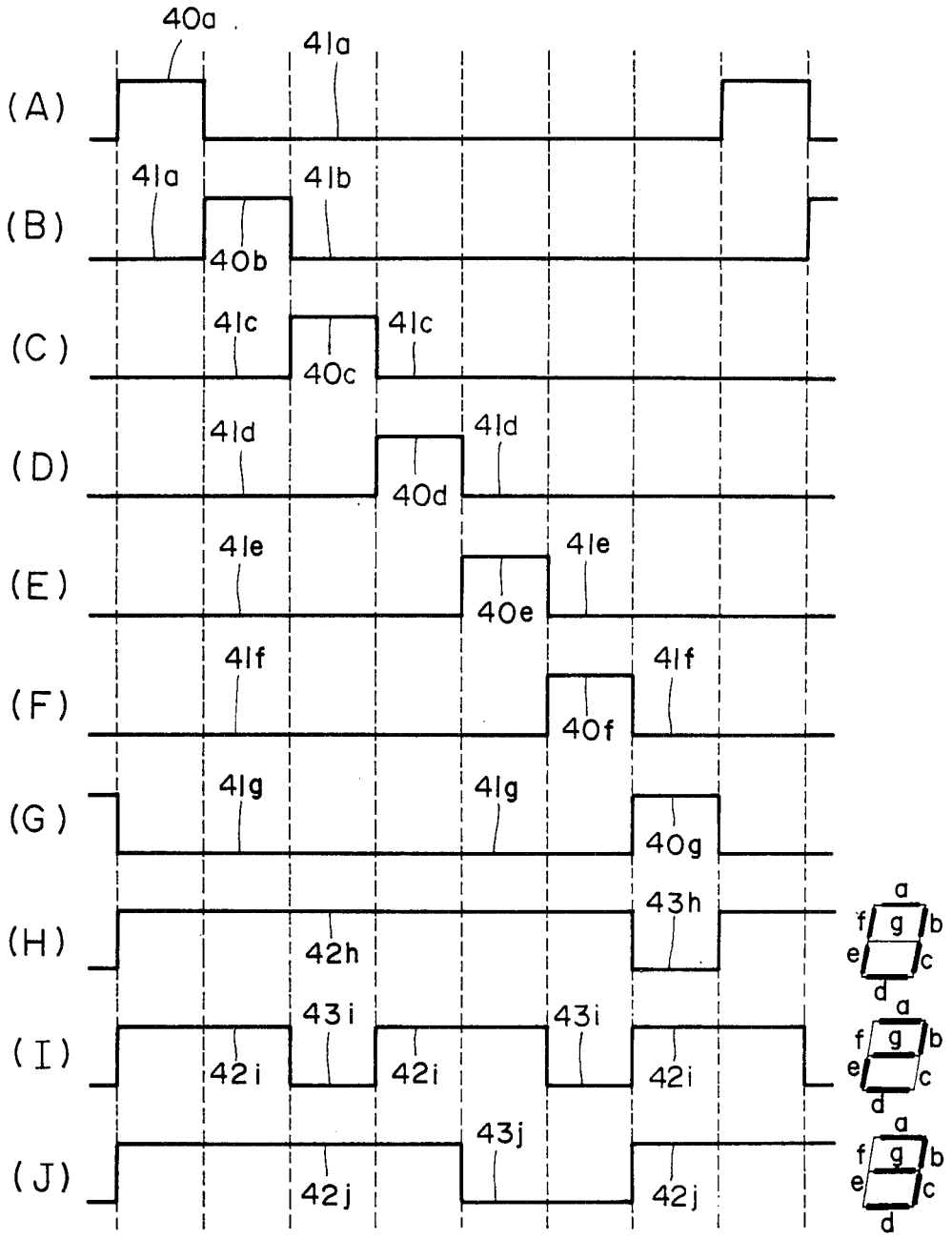
FIG. 5 is a timing chart of a segment scan signal and a light-emission command signal in the fluorescent display device of FIG. 1.

FIG. 5 is a timing chart of the segment scanning signal and light-emission command signal.

In the embodiment constructed in the manner as described hereinbefore, when a positive light-emission voltage is applied to control electrodes G of a display section 2 of a selected digit for a period of time during which a positive light-emission voltage is applied to an anode A of a fragment F of any segment of the display section 2, the anode A is allowed to emit light because the anode A and control electrode G forming the fragment F have a potential positive with respect to the cathode. Whereas, when a negative block voltage is applied to a control electrode G adjacent to an anode A having a positive light-emission voltage applied thereto, the positive electric field formed above the anode A is intercepted by the negative electric field generated by the control electrode G to shield electrons emitted from the cathode which are to impinge on the anode A, to thereby prevent light emission of the anode A.

Further, even when a positive light-emission voltage is applied to a control electrode G, the application of a negative block voltage to an anode A adjacent thereto allows a negative electric field generated by the anode A to shield electrons to prevent the electrons from impinging on the control electrode G; thus, the flowing of electrons into the control electrode G is blocked.

Thus, it will be readily noted that only when a positive light-emission voltage is concurrently applied to both of an anode A and a control electrode G of a fragment F adjacent to each other, the anode A is allowed to emit light.

Figure 6:
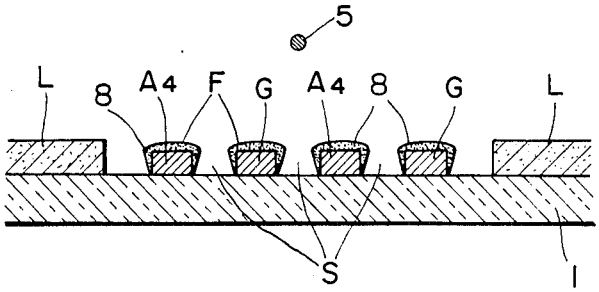
FIG. 6 is an enlarged view partly in section showing the essential part of a modification of the fluorescent display device shown in FIG. 1.

The embodiment illustrated may be modified as shown in FIG. 6 wherein control electrodes G each have a phospher layer depositied thereon as well as anodes A. The modification of FIG. 6 is adapted to permit not only the anodes A but the control electrodes G to carry out light emission, to thereby significantly improve the overall luminance of a display section and accomplish display of fine continuity.

More particularly, the modification of FIG. 6 is constructed so that when anodes A of any segment 3 in a display section 2 of a selected digit has applied thereto potential positive with respect to cathode potential and positive potential is applied to control electrodes G in the display section 2 of the selected digit, the anodes A and control electrodes G of the segment 3 may be permitted to emit light. Whereas, when potential negative with respect to cathode potential is applied to a control electrode G adjacent to an anode having positive potential applied thereto, the positive electric field formed around the anode A is eliminated by the negative electric field generated by the control electrode G to prevent electrons emitted from a cathode 5 from impinging on the anode A, to thereby prevent light emission of the anode A.

Further, in the modification of FIG. 6, even when positive potential is applied to a control electrode G, the application of negative potential to an anode A corresponding thereto permits electrons to be cut off by the negative electric field generated by the anode A to prevent the impingement of electrons on the anode, to thereby effectively hinder the control electrode from emitting light.

Thus, it will be noted that the modification is adapted to allow an anode A and a control electrode G forming a fragment to concurrently emit light only when positive potential is applied to both of the anode and control electrode.

Now, a dynamic driving manner of the fluorescent display device of the embodiment mentioned above according to a segment scanning method will be described hereinafter with reference to FIGS. 4 and 5.

FIGS. 5A to 5G show segment scanning signals respectively supplied to the corresponding segments 3*a* to 3*g* in the display sections 2 of the respective digits; and FIGS. 5H, 5I and 5J show light-emission command signals respectively supplied to the control electrodes G of any display sections, for example, the display sections $2_1$, $2_2$ and $2_3$.

The following description will be made in connection with an example of causing the display sections $2_1$, $2_2$ and $2_3$ to display numerals "0", "2" and "3", respectively.

First, from the segment scanning means 11, a positive light-emission voltage is supplied to the segments 3*a* (40*a* in FIG. 5A), whereas a negative block voltage is supplied to the other segments 3*b* to 3*g* (41*b* to 41*g* in FIGS. 5B to 5G). Then, a positive light-emission voltage is supplied to the segments 3*b* (40*b* in FIG. 5B) and a negative block voltage is applied to the other segments (41*a* in FIG. 5A and 41*c* to 41*g* in FIGS. 5C to 5G).

Similarly, a positive light-emission voltage is subsequently applied in turn to the respective segments in a manner such that a positive light-emission voltage is applied to one segment group and concurrently a negative block voltage is applied to the other segment groups.

When causing the display section $2_1$ of the first digit to display numeral "0", the segments 3*a*, 3*b*, 3*c*, 3*d*, 3*e* and 3*f* of the display section which are to emit light to display numeral "0" are applied thereto a positive lightemission voltage from the segment scanning means 11 for a period of time (40*a* in FIG. 5A, 40*b* in FIG. 5B, 40*c* in FIG. 5C, 40*d* in FIG. 5D, 40*e* in FIG. 5E and 40*f* in FIG. 5F), during which a positive light-emission voltage is applied to the control electrodes $G_1$ in the display section $2_1$ of the first digit from the light-emission command signal means 13 (42*h* in FIG. 5H).

In this case, a negative block voltage is applied to the control electrodes $G_1$ for a period of time (43*h* in FIG. 5H) during which a light-emission voltage is applied from the segment scanning means 11 to the segment 3*g* which is not emit light in the display of numeral "0".

Thus, it will be noted that the display section $2_1$ effectively carries out the display of numeral "0" by allowing the segments except the segment 2*g* to emit light.

Similarly, the display of numeral "2" by the display section $2_2$ of the second digit is accomplished in such a manner that a positive light-emission voltage is applied to the control electrodes $G_2$ for a period of time (42*i* in FIG. 5I) during which a positive light-emission voltage is applied to the segments 3*a*, 3*b*, 3*d*, 3*e* and 3*g* of the display section $2_2$ (40*a* in FIG. 5A, 40*b* in FIG. 5B, 40*d* in FIG. 5D, 40*e* in FIG. 5E and 40*g* in FIG. 5G); whereas a negative block voltage is applied to the control electrodes $G_2$ for a period of time (43*i* in FIG. 5I) during which a positive light-emission voltage is applied to the segments 3*c* and 3*f*.

Thus, the display section $2_2$ of the second digit can accomplish the display of numeral "2" by allowing the segments other than those 3*c* and 3*f* to emit light.

The display of numeral "3" by the display section $2_3$ of the third digit is carried out by applying a positive light-emission voltage to control electrodes $G_3$ for a period of time (42*j* in FIG. 5J) during which a positive light-emission voltage is applied to the segments 3*a*, 3*b*, 3*c*, 3*d* and 3*g* of the display section $2_3$ (40*a* in FIG. 5A, 40*b* in FIG. 5B, 40*c* in FIG. 5C, 40*d* in FIG. 5D and 40*g* in FIG. 5G) and applying a negative block signal to the control electrodes $G_3$ for a period of time (43*j* in FIG. 5J) during which a positive light-emission voltage is applied to the segments 3*e* and 3*f*, to thereby permit the segments other than those 3*e* and 3*f* to emit light.

As can be seen from the foregoing, the embodiment illustrated accomplished display of desired numerals by applying in turn a positive light-emission voltage 40 to the corresponding segments in the respective display sections and applying a positive light-emission voltage 42 to the control electrodes G of the display sections of the digits having the segments which are to emit light, in synchronism with the application of a light-emission voltage 40 to the segments which are to emit light; and further applying, when a positive light-emission voltage 40 is applied to the segments which are not to emit light, a negative block voltage 43 to the control electrodes G of the display sections of the digits having the segments which are not to emit light in synchronism with the application of a voltage 40.

Figure 7:
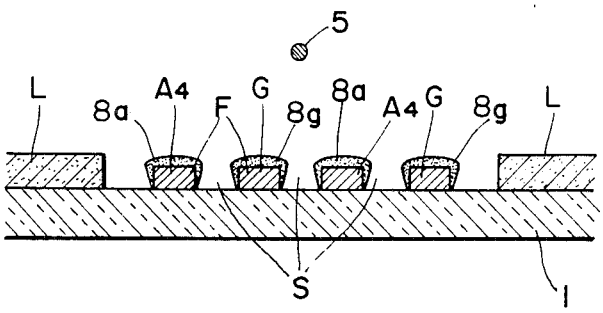
FIG. 7 is an enlarged view partly in section showing the essential part of a further modification of the fluorescent display device shown in FIG. 6.

FIG. 7 shows a modification of the fluorescent display device shown in FIG. 6, which is constructed in a manner to respectively deposit phosphor layers different in luminous color from each other on anodes and control electrodes to allow the anodes and control electrodes to emit lights different in luminous color from each other and carry out light emission of a mixed luminous color when the anodes and control electrodes concurrently emit light.

More particularly, the fluorescent display device shown in FIG. 7 includes anodes A and control electrodes G alternately arranged on a substrate 1 with an insulating space S of a suitable interval being interposed therebetween. The anodes A each have a phosphor layer 8*a* deposited on the surface thereof opposite to a cathode 5 and the control electrodes G each have a phosphor layer 8*g* deposited thereon which has a different luminous color from that of the anode A. The phosphor layer 8*a* of the anode and the phosphor layer 8*g* of the control electrode G may be formed of, for example, a ZnO:Zn phosphor having a green luminous color and a $(Zn_{1-x}Cd_x)$:Ag, A1, $(Y_2O_2S:Eu+In_2O_3)$, $SnO_2$:Eu or the like which has a red luminous color, respectively.

Figure 8:
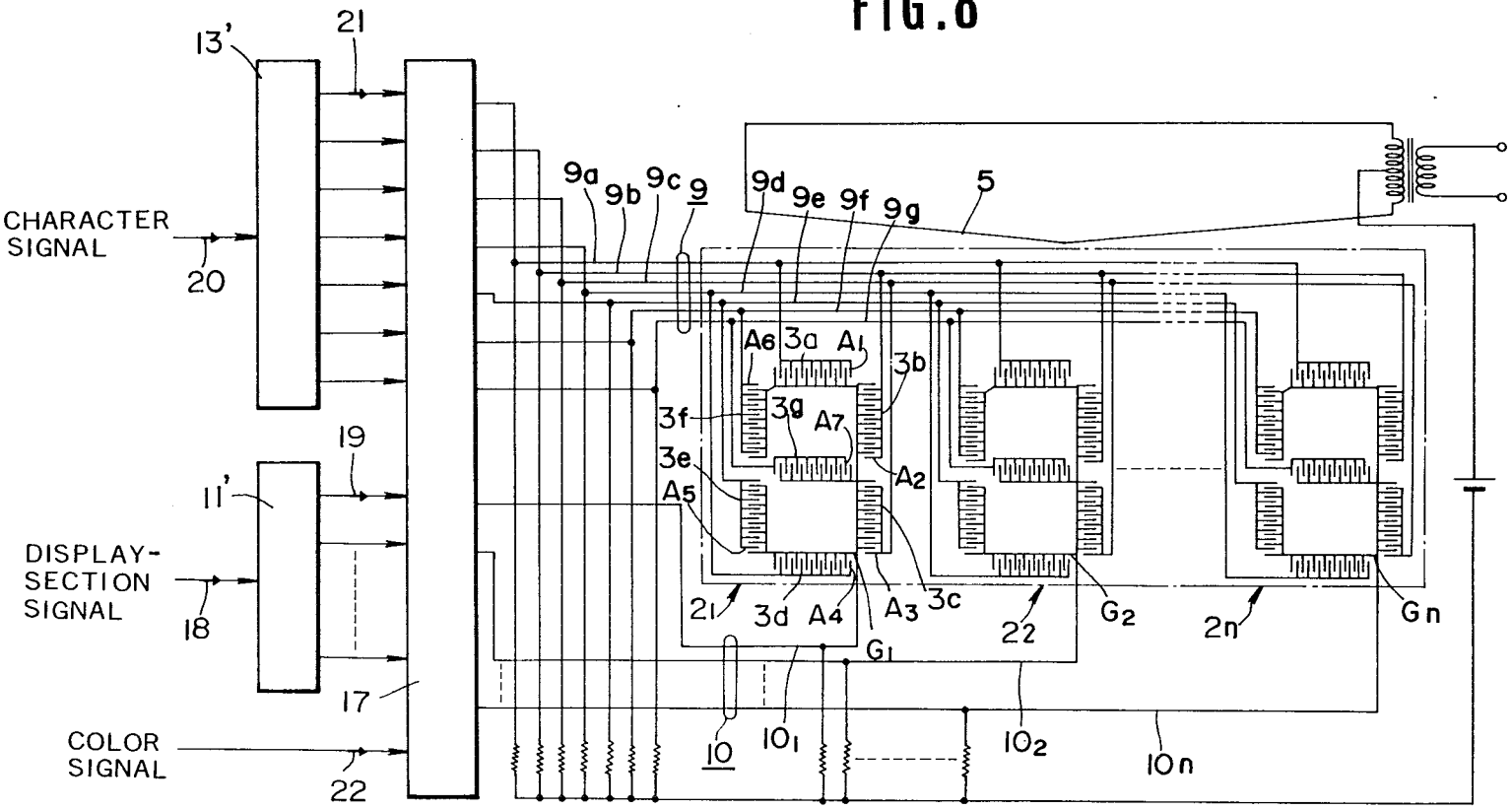
FIG. 8 is a diagram showing an electrical connection in the fluorescent display device of FIG. 7.

The anodes A of each display section 2, as shown in FIG. 8, are led out together every segment 3 in a manner such that anodes $A_1$ to $A_7$ of the segments 3*a* to 3*g* are respectively connected to first to seventh segment signal conductors 9*a* to 9*g* and each corresponding segments 3 in the respective display sections $2_1$ to $2_n$ are connected together to a common segment signal conductor 9.

The control electrodes G of each display section 2 are commonly connected throughout the segments of the display section 2. The control electrodes $G_1$ to $G_n$ of the respective display sections $2_1$ to $2_n$ are respectively connected to grid signal conductors $10_1$ $10_n$. Such connection is for a dynamic driving mechanism in a multi-digit fluorescent display device.

The fluorescent display device of FIG. 7, as shown in FIG. 8, also includes a display-section scanning means 11', a light-emission command signal means 13' and a color code signal processing means 17. The display-section scanning means 11' serves to receive a display-section or digit signal 18 to supply in turn a display-section selecting signal 19 to the control electrodes G. The light-emission command signal means 13' acts to receive a character signal 20 to selectively supply a light-emission command signal 21 to the anodes A. The color code signal processing means 17 is adapted to receive a color signal 22 to selectively provide the anodes A and control electrodes G with a light-emission voltage for allowing the anodes to emit light and a block release voltage for releasing the block of light-emission, respectively.

Figure 9:
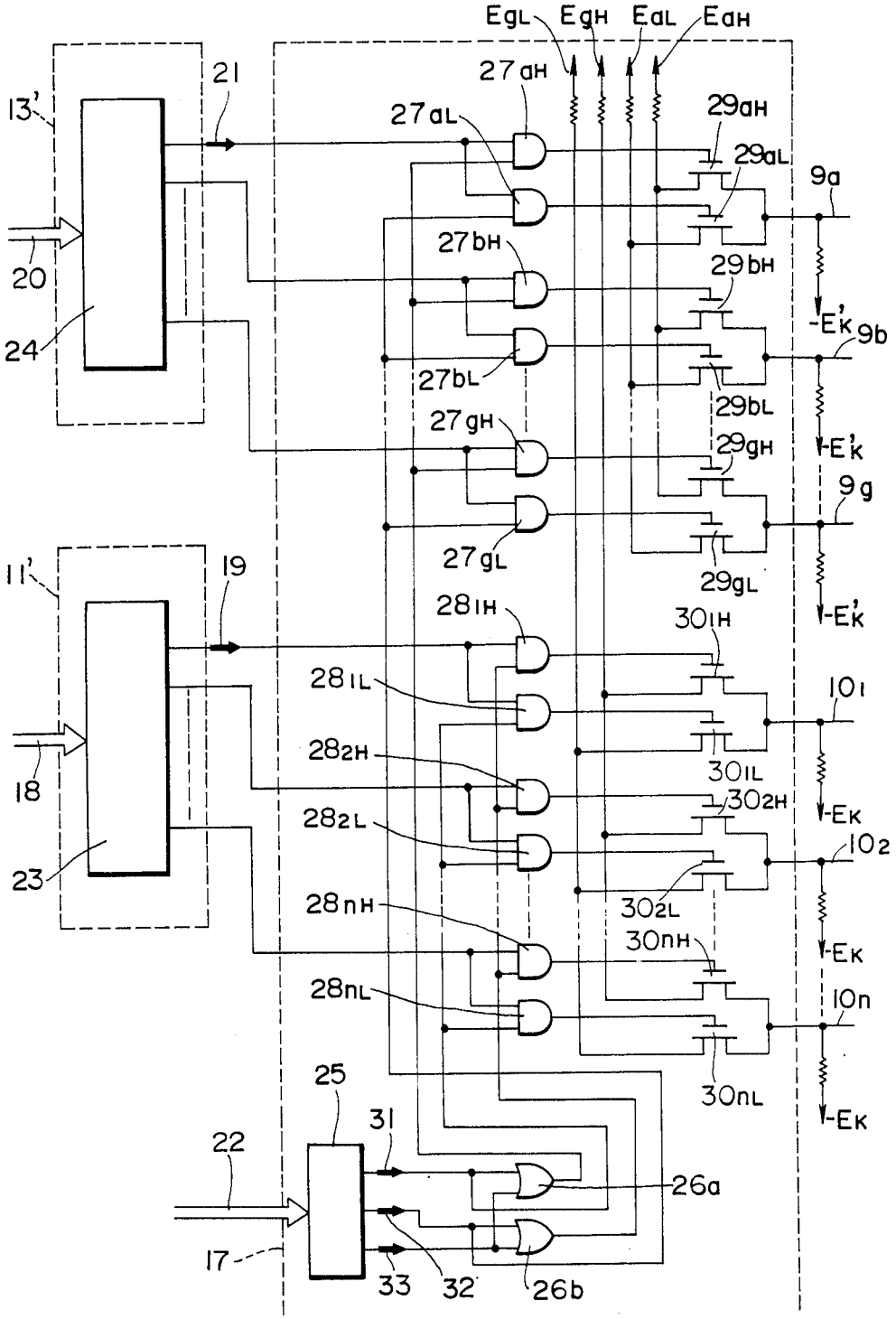
FIG. 9 is a diagram showing an electrical connection in the essential part of the fluorescent display device shown in FIG. 7.

The display-section scanning means 11', light-emission command signal means 13' and color code signal processing means 17 are respectively constructed in a manner as shown in FIG. 9.

More particularly, the display-section scanning means 11' and light-emission command signal means 13' respectively include a grid decoder 23 and a segment decoder 24 which are respectively connected through the color code signal processing means 17 to a grid signal conductor 10 and a segment signal conductor 9. The color code signal processing means 17 includes a color decoder 25 which is connected through two OR gates 26*a* and 26*b* to segment gates (AND gates) 27*a*H, 27*a*L to 27*g*H, 27*g*L and grid gates (AND gates) $28_1$H, $28_1$L to $28_n$H, $28_n$L, respectively. The segment gates 27*a*H and 27*a*L are connected through segment switches 29*a*H and 29*a*L to a segment signal conductor 9*a* which is connected to the segments 3*a*. Similary, each of the other segment gates 27 is connected through the corresponding segment switch 29 to the corresponding segment signal conductor 9 which is connected to the corresponding segment 3. Further, the grid gates $28_1$H and $28_1$L are connected through grid switches $30_1$H and $30_1$L to a grid signal conductor $10_1$ which is connected to the control electrodes $G_1$ in the display section $2_1$ of the first digit. Similarly, each of the remaining grid gates 28 is correspondingly connected through a grid switch 30 to a grid signal conductor 10 which is connected to control electrodes G.

The grid signal conductor 10 is connected to the control electrodes G and further connected through a resistor to a first block voltage source −Ek, and the segment signal conductor 9 is connected to the segment 3 and further connected through a resistor to a second block voltage source −E'k.

The grid switch 30H is connected to a first light-emission voltage source EgH and the grid switch 30L is connected to a first block release voltage source EgL; and the segment switch 29H is connected to a second light-emission voltage source EaH and the segment switch 29L is connected to a second block release voltage source EaL.

The term "block release voltage" used herein means a voltage which allows electrons to uniformly impinge on adjacent electrodes to cause electrodes to emit light but does not emit light per se.

Figure 10:
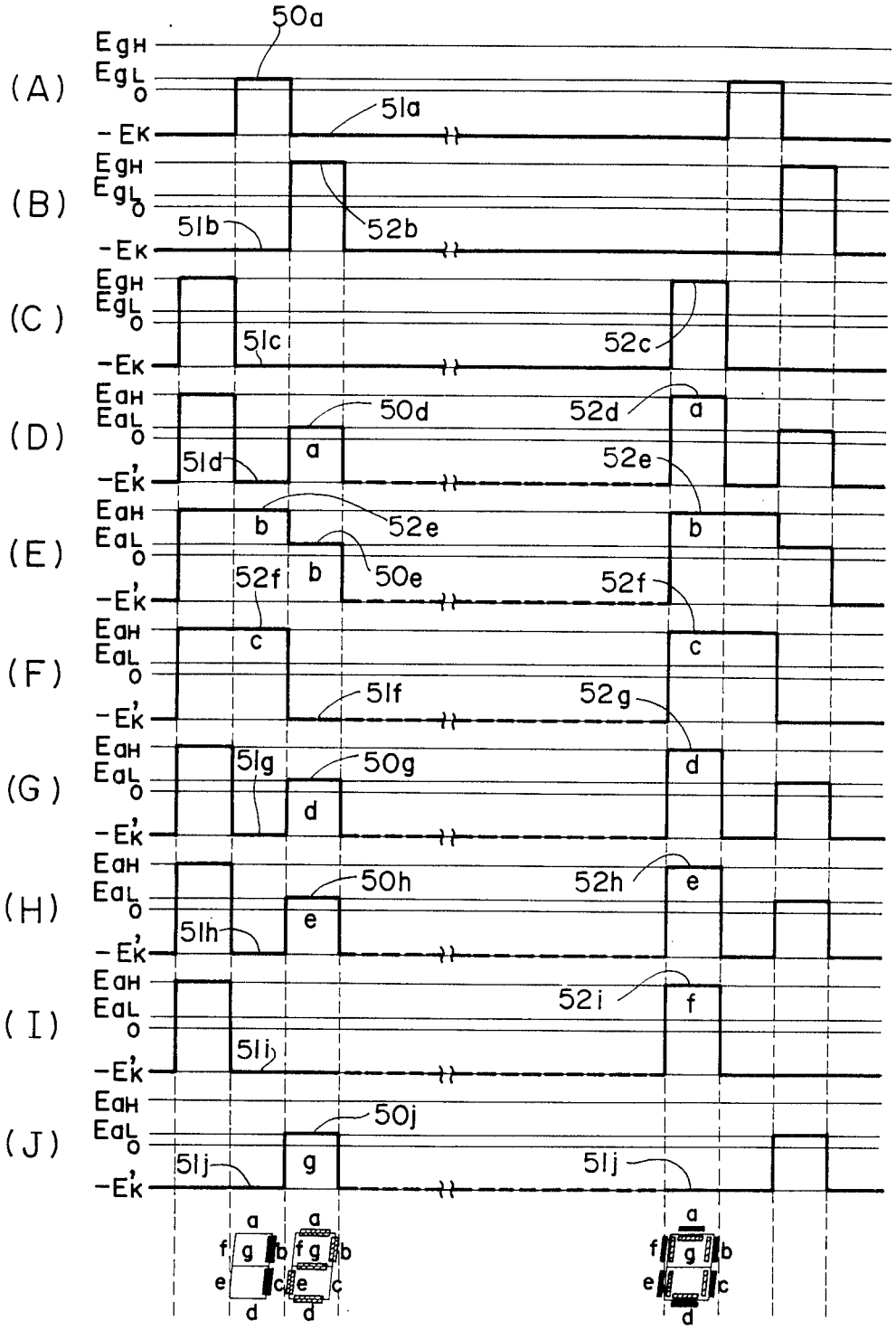
FIG. 10 is a timing chart showing a segment scan signal and a light-emission command signal in the fluorescent display device of FIG. 7.

The manner of operation of the fluorescent display device shown in FIG. 7 will be described with reference to FIG. 10 which is a timing chart of the display-section scanning signal and light-emission command signal.

In the fluorescent display device constructed in the manner as described hereinbefore, a block release voltage EgL positive with respect to a cathode voltage is applied to control electrodes G in a display section 2 of a selected digit for a period of time, during which when a light-emission voltage EaH positive with respect to a cathode voltage is applied to an anode A of a fragment F of any segment 3 in the display section 2, the anode A emits light of a green luminous color due to the impingement of electrons thereon because there is no shielding action of preventing electrons emitted from the cathode 5 from impinging on the anode A. In this case, the control electrode does not emit light because electrons do not impinge on the control electrode to a degree sufficient to allow the electrode to emit light. However, when a light-emission voltage EgH is applied also to the control electrode at this time, the control electrode emits light of a red luminous color, which cooperates with light of a green luminous color emitted from the anode A to permit the segment to emit light of a mixed color therebetween. Then, when a negative block voltage −Ek is applied to the control electrodes G; the control electrodes G generate a negative electric field therearound, which acts to cut off the positive electric field formed around the anodes A. This causes electrons emitted from the cathode 5 which are to impinge on the anodes to be shielded, to thereby prevent light-emission of the anodes A.

Whereas, even when a positive light-emission voltage EgH is applied to the control electrodes; the application of a negative block voltage −E'k to the adjacent anodes A causes electrons to be shielded by the negative electric field generated by the anodes, to thereby prevent the electrons from impinging on the control electrodes; so that the control electrodes may not emit light at all. In this case, the application of a block release voltage EaL to the anodes A allows the control electrodes to initiate light emission of a red luminous color. Also, the anodes A, when a positive light-emission voltage EaH is applied thereto, emits light of a green luminous color.

Thus, it will be noted that, in the fluorescent display device of FIG. 7, the application of a light-emission voltage $E_H$ to one of the anode and control electrode adjacent to each other and a block release voltage to the other electrode allows the one electrode to emit light, the application of a light-emission voltage $E_H$ to the both electrodes permits the both electrodes to emit light together to provide light of a mixed color therebetween, and the application of a block voltage to one of the both electrodes prevents light emission of the both electrodes.

Now, the manner of dynamic driving operation of the fluorescent display device of FIG. 7 utilizing grid scanning techniques will be hereinafter described with reference to FIG. 10.

FIGS. 10A, 10B and 10C respectively show scan signals supplied to control electrodes G of any display sections, for example, the control electrodes $G_1$, $G_2$ and $G_3$ of the display sections $2_1$, $2_2$ and $2_3$; and FIGS. 10D to 10J respectively show light-emission command signals supplied to the corresponding segments 3*a* to 3*g* in the display sections of the respective digits.

The following description will be made in connection with an example of causing the display sections $2_1$, $2_2$ and $2_3$ to display numeral "1" of a green luminous color, numeral "2" of a red luminous color and numeral "0" of a mixed luminous color therebetween.

First, a block release voltage is applied to the grid $G_1$ of the display section $2_1$ (50*a* in FIG. 10A) from the display-section scanning means 11' while the remaining control electrodes $G_2$ to $G_n$ are kept at a negative voltage (51*b* in FIG. 10B, 51*c* in FIG. 10C).

Similarly, one of a block release voltage and a light-emission voltage which are voltages other than a block voltage is applied in turn to the respective control electrodes. At this time, the control electrodes other than that having a block release voltage or a light-emission voltage applied thereto are kept at a negative block voltage.

The display of numeral "1" of a green luminous color by the display section $2_1$ of the first digit is accomplished by applying a positive light-emission voltage (52*e* in FIG. 10E, 52*f* in FIG. 10F) from the light-emission command signal means 13' to the anodes $A_2$ and $A_3$ of the segments 3*b* and 3*c* which are to emit light to display numeral "1" in the display section $2_1$ of the first digit for a period of time (50*a* in FIG. 10A) during which a block release voltage is applied to the control electrodes $G_1$ of the display section $2_1$ from the display-section scanning means 11'.

In this case, a negative block voltage is applied to anodes $A_1$ and $A_4$ to $A_7$ of segments 3*a* and 3*d* to 3*g* in the display section $2_1$ which are not to emit light for the display of numeral "1" (51*d* in FIG. 10D, 51*g* in FIG. 10G, 51*h* in FIG. 10H, 51*i* in FIG. 10I, 51*j* in FIG. 10J).

Thus, it will be noted that, in the display section $2_1$, the anodes $A_2$ and $A_3$ of the segments 3*b* and 3*c* emit light of a green luminous color to carry out the display of numeral "1". At this time, the control electrodes $G_1$ are kept at a block release voltage so that the light emission is prevented.

As can be seen from the foregoing, the display of desired numerals by the anodes A in the display sections of the respective digits can be effectively carried out by applying a block release voltage EgL to the control eletrodes G in turn every display section and applying a positive light-emission voltage EaH to the anodes A of the segments 3 to emit light in the display section 2 in synchronism with the application of a block release voltage to the control electrodes, to thereby allow the desired anodes A to emit light of a green luminous color.

The display of numeral "2" of a red luminous color by the display section $2_2$ of the second digit is carried out in the following manner.

First, a light-emission voltage is applied to the control electrodes $G_2$ of the display section $2_2$ from the display-section scanning means 11' (52*b* in FIG. 10B) while the remaining control electrode $G_2$ to $G_n$ are kept at a block voltage (51*a* in FIG. 10A, 51*c* in FIG. 10C).

Then, a block release voltage is applied from the light-emission command signal means 13' to the anodes $A_1$, $A_2$, $A_4$, $A_5$ and $A_7$ of the segments 3*a*, 3*b*, 3*d*, 3*e* and 3*g* which are to emit light for the display of numeral "2" in the display section $2_2$ (50D in FIG. 10D, 50*e* in FIG. 10E, 50*g* in FIG. 10G, 50*h* in FIG. 10H, 50*j* in FIG. 10J) for a period of time during which a light-emission voltage is applied from the display-section scannning means 11' to the control electrodes $G_2$ in the display section $2_2$ of the second digit (52*b* in FIG. 10B).

At this time, the anodes $A_3$ and $A_6$ of the segments 3*c* and 3*f* which are not to contribute to the display of numeral "2" are applied thereto a block voltage (51*f* in FIG. 10F, 51*i* in FIG. 10I).

Thus, the display section $2_2$ allows the control electrodes $G_2$ of the segments 3*a*, 3*b*, 3*d*, 3*e* and 3*g* to emit light of a red luminous color to carry out the display of numeral "2". The control electrodes $G_2$ of the segments 3*c* and 3*f* do not emit light because the electrodes are exposed to the negative electric field due to a block voltage applied to the anodes $A_3$ and $A_6$. Further, the anodes $A_1$, $A_2$, $A_4$, $A_5$ and $A_7$ of the segments 3*a*, 3*b*, 3*d*, 3*e* and 3*g* also do not emit light because the anodes are kept at a block release voltage.

In view of the foregoing, it will be readily understood that the display of desired numerals of a red luminous color in the display sections can be accomplished by applying a light-emission voltage EgH to the control electrodes G in turn every display section 2 and a block release voltage EaL to the anodes A of the segments 3 which are to emit light in the display section 3 in synchronism with the application of a light-emission voltage to the control electrodes G, to thereby allow the control electrodes to emit light of a red luminous color.

The manner of display of numeral "0" of a mixed luminous color between green and red by the display section $2_n$ of the nth digit will be described hereinafter.

A light-emission voltage is applied to the control electrodes $G_n$ of the display section $2_n$ from the display-section scanning means 11' (52*c* in FIG. 10C) while the control electrodes $G_1$ and $G_2$ are kept at a block voltage (51*a* in FIG. 10A, 51*b* in FIG. 10B).

Next, a light-emission voltage is applied from the light-emission command signal means 13' to the anodes $A_1$ to $A_6$ of the segments 3*a* to 3*f* in the display section $2_n$ which are to emit light to display numeral "0" in the display section for a period of time (52*d* in FIG. 10D, 52*e* in FIG. 10E, 52*f* in FIG. 10F, 52*g* in FIG. 10G, 52*h* in FIG. 10H, 52*i* in FIG. 10I) during which a light-emission voltage is applied to the control electrodes $G_n$ of the display section $2_n$ (52*c* in FIG. 10C).

At this time, the anodes $A_7$ of the segment 3*g* which are not to emit light in the display of numeral "0" are applied thereto a block voltage (41*j* in FIG. 10J).

Thus, the display section $2_n$ allows the control electrodes $G_n$ of the segments 3*a* to 3*f* to emit light of a red luminous color and the anodes $A_1$ to $A_6$ of these segments to emit light of a green luminous color, to thereby carry out numeral "0" display of the mixed luminous color. In this case, the control electrodes $G_n$ of the segment 3*g* are prevented from emitting light by a block voltage applied to the adjacent anodes $A_7$.

In view of the above, it will be understood that the display of desired numerals of the mixed luminous color can be carried out by applying a light-emission voltage EgH to the control electrodes G in turn every display section and applying a light-emission voltage EaH to the anodes A of the segment 3 which are to emit light in the display section 2 in synchronism with the application of a light-emission voltage to the control electrodes G, to thereby allow the control electrodes G and anodes A in the segment 3 to concurrently emit lights of a red luminous color and a green luminous color, respectively.

The manner of selective supply of a block voltage, a block release voltage and a light-emission voltage from the display-section scanning means 11', light-emission command signal means 13' and color code signal processing means 17 to the fluorescent display tube will be described with reference to FIG. 9.

First, when causing the anodes A to emit light of a green luminous color, a color signal 22 indicating green is supplied from a central processing device (not shown) to the color decorder 25, which decodes the signal 22 and supplied "1" as a green color control signal 31 through the OR gate 26*a* to each one input terminal of the segment gates 27*a*H to 27*g*H to provide the gates with an opportunity of outputting the signal "1". In addition, the "1" as a green color control signal 31 is supplied to each one input terminal of the grid gates $28_1$L to $28_n$L to give the gates an opportunity of outputting the signal "1".

Also, a display-section signal 18 is supplied from the central processing device to the grid decoder 23, which decodes the signal and distributes "1" as a displaysection selecting signal 19 to the input terminal of each of the grid gates $28_1$H and $28_1$L to $28_n$H and $28_n$L in turn.

This results in the grid gates $28_1$L to $28_n$L of which the one input terminal having the signal "1" previously supplied thereto being applied to the both input terminals thereof the signal "1" and outputting it in turn and in an alternative way to change the grid switches $30_1$L to $30_n$L to "ON" in turn and in an alternative way, thus, the control electrodes G of each display section 2 which have been kept at a first block voltage $-E_k$ are applied thereto a first block release voltage EgL through the grid signal conductors $10_1$ to $10_n$ in turn and in an alternative way.

Whereas, during the operation, a character signal 20 is supplied from the central processing device to the segment decoder 24, which decodes the signal and supplies in parallel "1" as a light-emission command signal 21 to the other input terminals of each pair of segment gates 27*a*H and 27*a*L to 27*g*H and 27*g*L to provide the segment gates with an opportunity of outputting the signal "1".

At this time, only the segment gates 27H which belong to the segment gates 27*a*H to 27*g*H each having "1" previously supplied to the one input terminal thereof from the OR gate 26*a* and have a light-emission command signal 21 supplied thereto are applied to the both input terminals thereof the signal "1" and output it to change the corresponding segment switches 29H to "ON", so that a second light-emission voltage EaH is supplied through the segement signal conductors 9 to the anodes A of the segments which are to emit light in each of the display sections 2 previously kept at a second block voltage −E'k.

When causing the control electrodes to emit light of a red luminous color, the color decoder 25 receives a color signal 22 indicating red and decodes it to supply "1" as a red color control signal 32 through the OR gate 26*b* to each one input terminal of the grid gates $28_1$H to $26_n$H. Also, the signal "1" which is a red color control signal 32 is also supplied to each one input terminal of the segment gates 27*a*L to 27*g*L.

In operation of the segment decoder 24, the segment switches 29L corresponding to the segments which are to emit light are changed to "ON" to allow a second block release voltage EaL to be supplied to the segments.

Further, in operation of the decoder 23 concurrently conducted with operation of the segment decoder 24 and color decoder 25, the grid switches $30_1$H to $30_n$H are changed to "ON" in turn and in an alternative way to permit a first light-emission voltage to be supplied to the control electrodes G of each display section 2.

When causing the anodes A and control electrodes G to concurrently emit lights of green and red luminous colors to obtain display of the mixed color, the color decoder 25 supplies a signal "1" as a mixed color control signal 33 through the OR gate 26*b* to each one input terminal of the grid gates $28_1$H to $28_n$H.

Also, the signal "1" acting as a mixed color control signal 33 is supplied through the OR gate 26*b* to each one input terminal of the segment gates 27*a*H to 27*g*H.

In such case of causing emission of green and red lights, the segment switches 29H corresponding to the segments which are to emit light are changed to "ON" to permit a second light-emission voltage EaH to be supplied to the anodes A of the segments which are to emit light. Whereas, the grid switches $30_1$H to $30_n$H are changed to "ON" in turn and in an alternative way to allow a first light-emission voltage to be applied to the control electrodes G of each display section 2.

In the modificatin shown in FIG. 7, the phosphor layer 8*a* deposited on the anode A is different in luminous color from that of the control electrode G, therefore, the both electrodes are generally different in light-emission initiating voltage from each other. Thus, typically, a light-emission voltage EaH and a block voltage −Ek of the anode are set at optimum values different from those of the control electrode.

Figure 11:
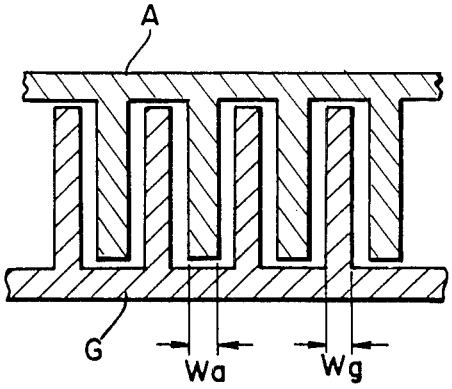
FIG. 11 is an enlarged view showing the essential part of a modification of the fluorescent display device shown in FIG. 7.

Also, in the fluorescent display device having phosphor layers different in luminous characteristics from each other respectively deposited on the anode and control electrode, it is preferable to render width Wa of the electrode of a low light-emission voltage or the anode emitting light of a green luminous color large, as compared with width Wg of the electrode of a high light-emission voltage or the control electrode emitting red light, as shown in FIG. 11. This allows the electric field of the anode A having a block voltage applied thereto to substantially affect the control electrode G having a high light-emission voltage applied thereto to enhance a shielding effect on the control electrode.

In the modifications of FIGS. 6 and 7, the anode has a phosphor layer emitting light of a green luminous color deposited thereon and the control electrode has a phosphor layer of red light deposited thereon. However, the fluorescent display device of the present invention is not limited to such phosphor materials.

Obviously many modifications and variations of the present invention are possible in the light of the above teachings. It is therefore to be understood that within the scope of the appended claims the invention may be practiced otherwise than as specifically described.

What is claimed is:

1. A fluorescent display device comprising:

a substrate;

at least one display section formed on said substrate, said display section consisting of a plurality of segments; and a cathode spaced from said segments;

means for maintaining an evacuated space between said cathode and said segments and for permitting external viewing of said segments;

said segments each comprising anode electrodes and control electrodes alternately arranged in a pectinate configuration with interleaved portions on one surface of said substrate and with an insulating space being interposed therebetween;

said anode electrodes each having a phosphor layer deposited on the surface thereof opposite to said cathode;

said control electrodes each having a phosphor layer deposited on the surface thereof opposite to said cathode;

wherein all of said anode electrodes are connected together to an external terminal in every segment and all of said control electrodes are connected together to an external terminal in every display section.

2. The fluorescent display device as defined in claim 1, wherein said phosphor layer deposited on said control electrode is formed of a phosphor which emits light of a luminous color different from, and requiring a light emision initiating voltage different from, said phosphor layer deposited on said anode electrode.

3. The fluorescent display device of claim 1, wherein one of said anode and control electrodes having a phosphor requiring a light emission initiating voltage lower than that of the other of said electrodes has a width greater than that of said other of said electrodes by a degree sufficient to permit shielding of said other of said electrodes.

4. The fluorescent display device of claim 2, wherein one of said anode and control electrodes having a phosphor requiring a light emission initiating voltage lower than that of the other of said electrodes has a width greater than that of said other of said electrodes by a degree sufficient to permit shielding of said other of said electrodes.

* * * * *